US009872808B2

(12) United States Patent
Gipson

(10) Patent No.: US 9,872,808 B2
(45) Date of Patent: Jan. 23, 2018

(54) MEDICATIONS DISPENSING CART

(71) Applicant: Seneca Gipson, Fayetteville, GA (US)

(72) Inventor: Seneca Gipson, Fayetteville, GA (US)

( * ) Notice: Subject to any disclaimer, the term of this patent is extended or adjusted under 35 U.S.C. 154(b) by 0 days.

(21) Appl. No.: 15/176,256

(22) Filed: Jun. 8, 2016

(65) Prior Publication Data

US 2017/0354562 A1 Dec. 14, 2017

(51) Int. Cl.

| | |
|---|---|
| ***A47B 31/02*** | (2006.01) |
| ***A61G 12/00*** | (2006.01) |
| ***E05B 65/46*** | (2017.01) |
| *A47B 31/00* | (2006.01) |

(52) U.S. Cl.

CPC ..... *A61G 12/001* (2013.01); *A47B 31/02* (2013.01); *E05B 65/46* (2013.01); *A47B 2031/003* (2013.01); *A47B 2031/006* (2013.01); *A47B 2220/0077* (2013.01)

(58) Field of Classification Search

CPC ..... A47B 31/02; A61G 12/001; E05B 65/46
USPC ..... 312/209, 216, 249.1, 249.8, 249.11, 215
See application file for complete search history.

(56) References Cited

U.S. PATENT DOCUMENTS

| | | | | |
|---|---|---|---|---|
| 2,401,226 | A * | 5/1946 | Calvert | E05G 5/02 109/10 |
| 3,471,947 | A * | 10/1969 | Genser | A47B 17/04 312/10.1 |
| 4,114,965 | A | 9/1978 | Oye et al. | |
| 4,588,237 | A | 5/1986 | Marder | |
| D367,349 | S | 2/1996 | Insalaco et al. | |
| 5,564,803 | A | 10/1996 | McDonald et al. | |
| 5,979,337 | A * | 11/1999 | Clark | A47B 23/06 108/23 |
| 6,726,294 | B1 * | 4/2004 | Muller | E05B 65/462 312/215 |
| 2007/0228680 | A1 * | 10/2007 | Reppert | A47B 21/00 280/47.35 |
| 2009/0037020 | A1 * | 2/2009 | Brown | G07F 17/0092 700/240 |
| 2011/0068562 | A1 | 3/2011 | Keffeler et al. | |
| 2012/0232692 | A1 * | 9/2012 | Liu | G06F 19/3456 700/236 |
| 2012/0245731 | A1 * | 9/2012 | Reckelhoff | A61G 12/001 700/243 |
| 2013/0057133 | A1 * | 3/2013 | Kool | A47B 31/02 312/236 |
| 2014/0184038 | A1 * | 7/2014 | Shoenfeld | G07C 9/00111 312/209 |
| 2015/0227127 | A1 * | 8/2015 | Miller | G05B 19/042 700/244 |

* cited by examiner

*Primary Examiner* — James O Hansen

(57) ABSTRACT

An medications dispensing cart for dispensing medications includes a cabinet that has a front, a back, a left side, a right side, a top and a bottom defining an internal space. A pair of left walls and a pair of right walls are positioned in the internal space. Drawers are positioned between and slidably coupled to each of the pairs of walls. Rollers are coupled to the bottom and a cooler is positioned in the top. A light, operationally coupled to a power module, is extendable from the interior space through a complimentary aperture in the top. Electronic locks, controlled by a keypad, are coupled to the drawers. A manual lock also is coupled to each of the drawers. A pill manipulator that is capable of cutting and crushing pills is positioned on the top.

18 Claims, 5 Drawing Sheets

MEDICATIONS DISPENSING CART

BACKGROUND OF THE DISCLOSURE

Field of the Disclosure

The disclosure relates to carts and more particularly pertains to a new cart for dispensing medications.

SUMMARY OF THE DISCLOSURE

An embodiment of the disclosure meets the needs presented above by generally comprising a cabinet that has a front, a back, a left side, a right side, a top and a bottom defining an internal space. A pair of left walls and a pair of right walls are positioned in the internal space. Drawers are positioned between and slidably coupled to each of the pairs of walls. Rollers are coupled to the bottom and a cooler is positioned in the top. A light, operationally coupled to a power module, is extendable from the interior space through a complimentary aperture in the top. Electronic locks, controlled by a keypad, are coupled to the drawers. A manual lock also is coupled to each of the drawers. A pill manipulator that is capable of cutting and crushing pills is positioned on the top.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
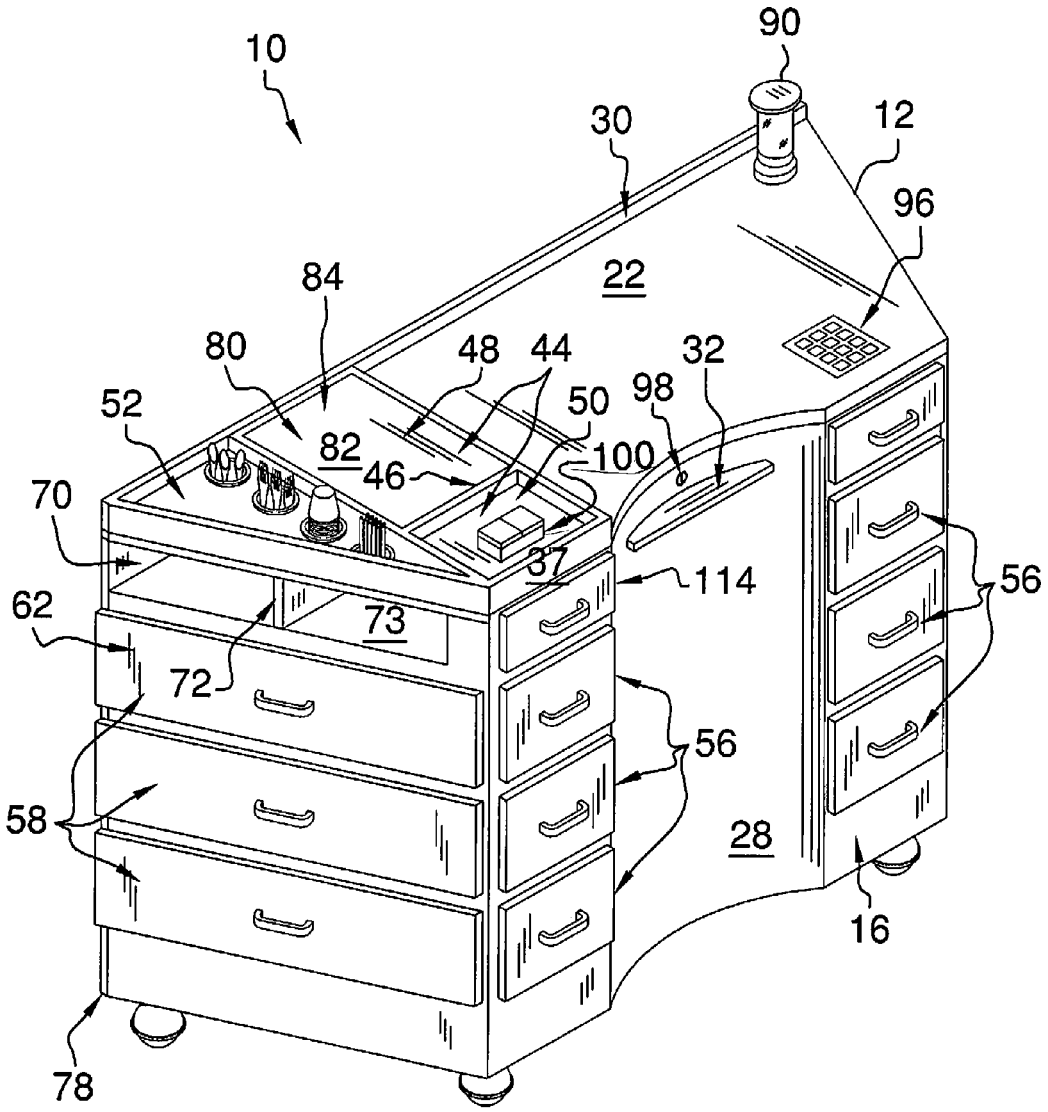
FIG. 1 is an isometric perspective view of an medications dispensing cart according to an embodiment of the disclosure.
Figure 2:
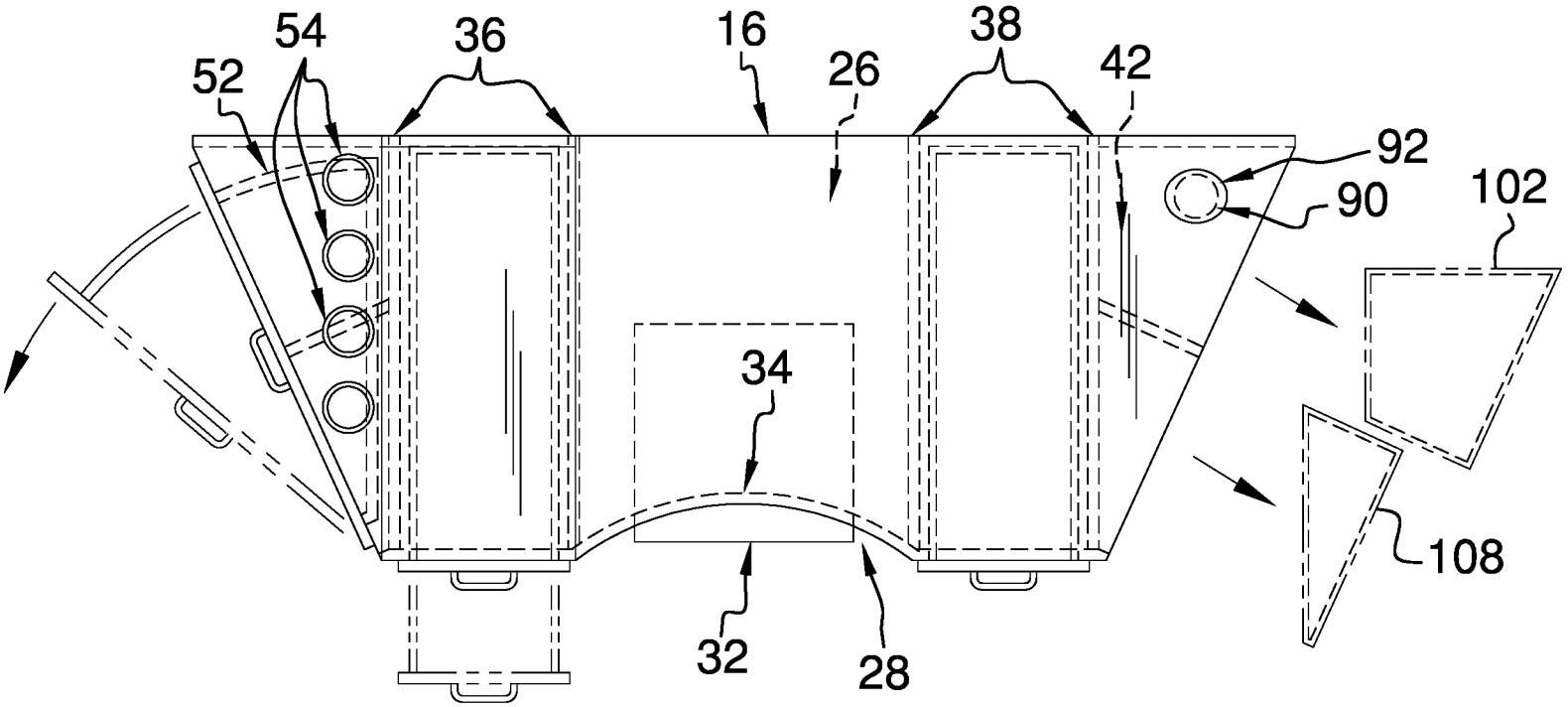
FIG. 2 is a top view of an embodiment of the disclosure.
Figure 3:
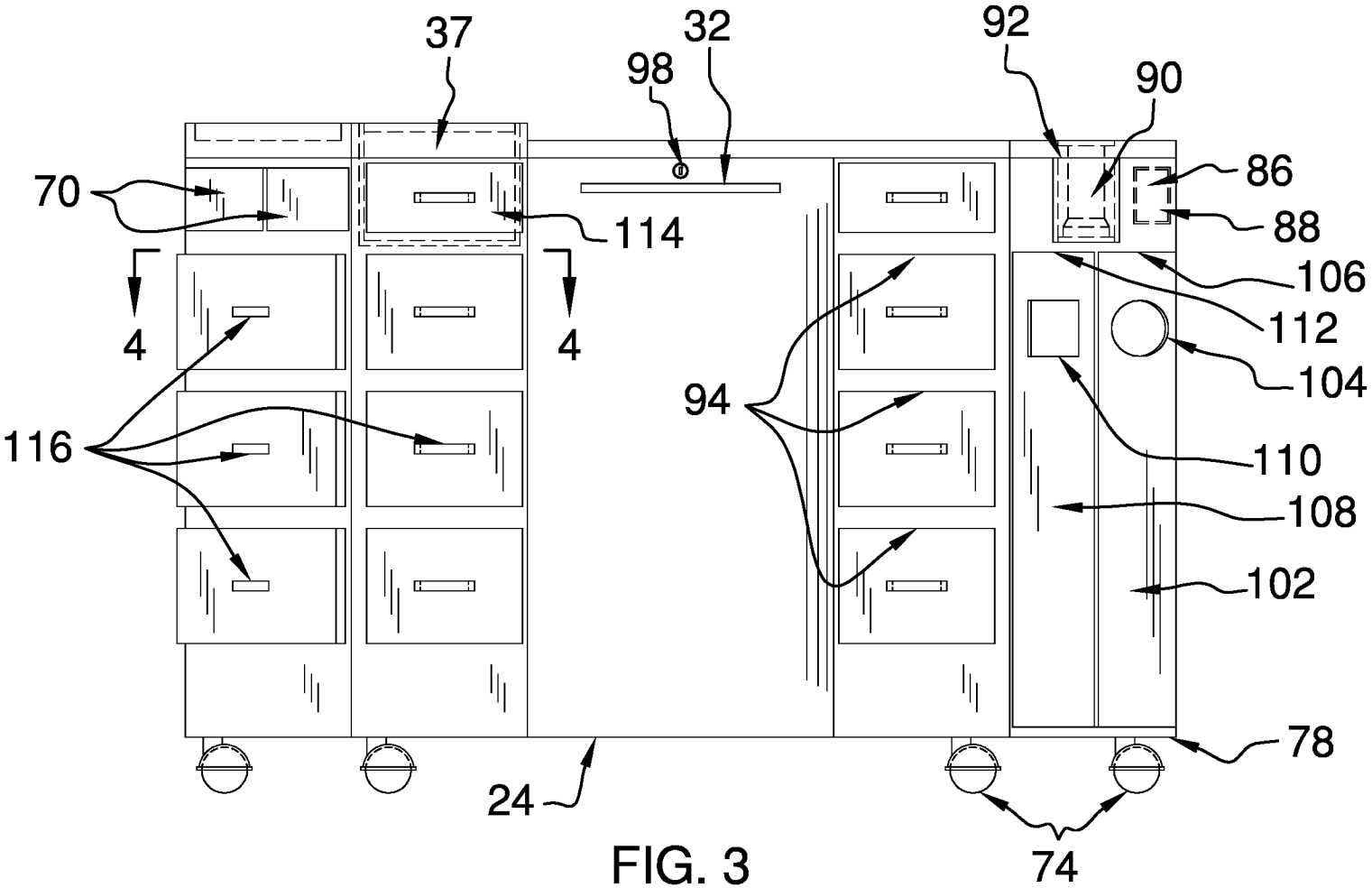
FIG. 3 is a front view of an embodiment of the disclosure.
Figure 4:
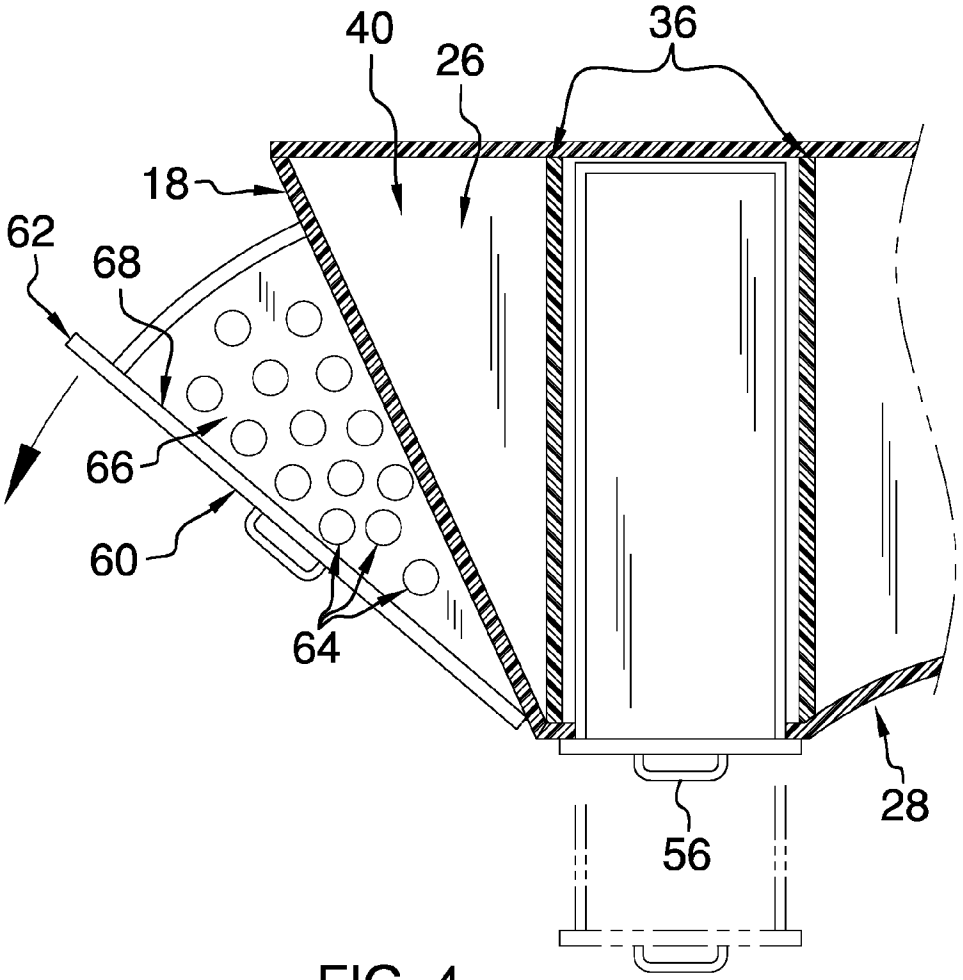
FIG. 4 is a detail view of an embodiment of the disclosure.
Figure 5:
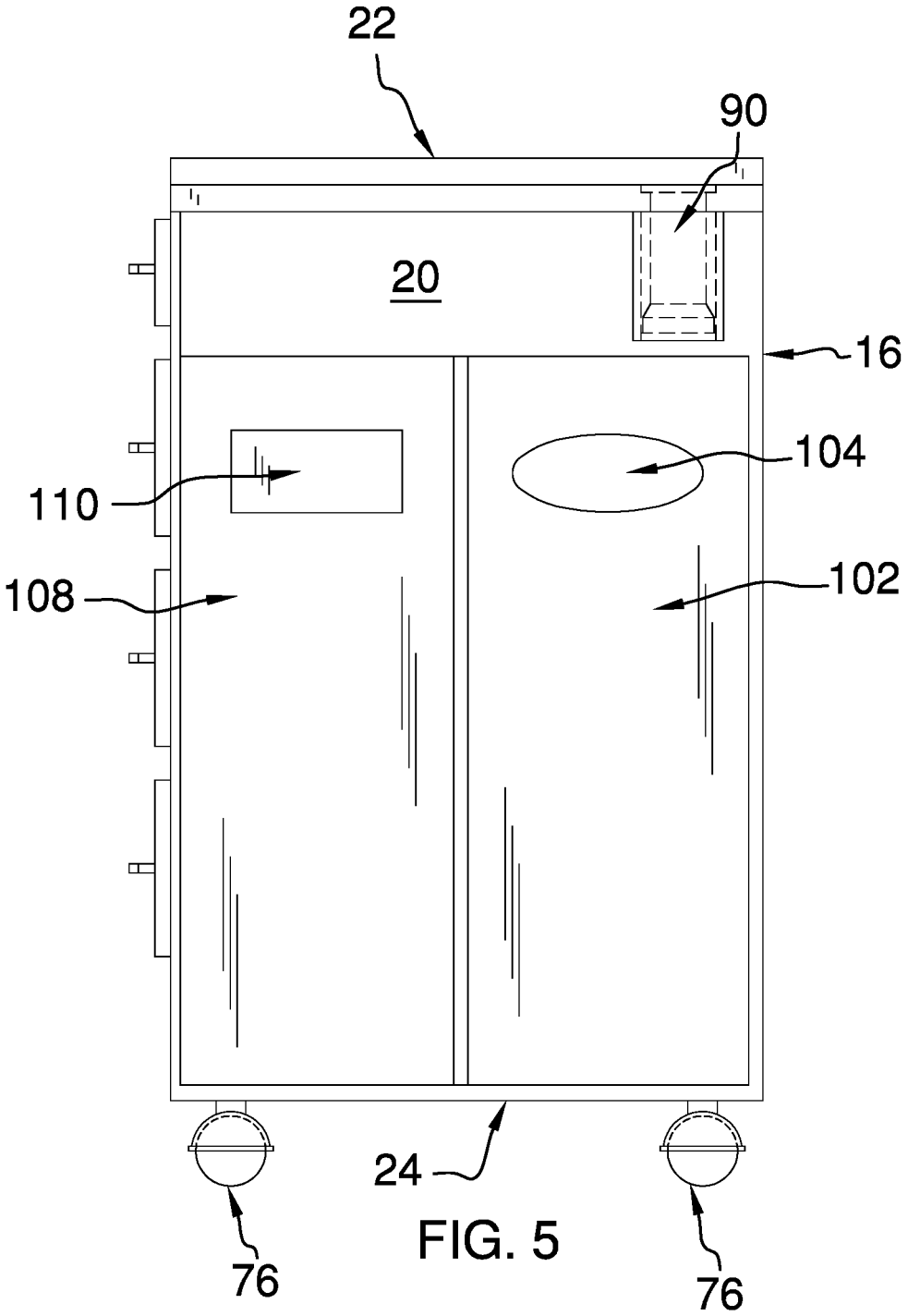
FIG. 5 is a right side view of an embodiment of the disclosure.

With reference now to the drawings, and in particular to FIGS. 1 through 5 thereof, a new cart embodying the principles and concepts of an embodiment of the disclosure and generally designated by the reference numeral 10 will be described.

As best illustrated in FIGS. 1 through 5, the medications dispensing cart 10 generally comprises a cabinet 12 that has a front 14, a back 16, a left side 18, a right side 20, a top 22 and a bottom 24, which together define an internal space 26. An arcuate cavity 28 is positioned in the front 14 substantially equally distant from the left side 18 and the right side 20. The cavity 28 extends from the bottom 24 to the top 22, such that the cavity 28 is positioned to accommodate the user. The back 16 extends past the top 22, defining a retaining ridge 30.

A shelf 32 is slidably extendable from the interior space 26 through a complimentary slot 34 in the front 14. The slot 34 is positioned in the arcuate cavity 28 proximate to the top 22. A pair of left walls 36 and a pair of right walls 38 are positioned in the internal space 26. Each of the walls 36 and 38 is coupled to the front 14, the back 16, the top 22 and the bottom 24. The pair of left walls 36 is positioned proximate to the left side 18. The pair of right walls 38 is positioned proximate to the right side 20. The back 16 is dimensionally wider than the front 14, such that the left side 18 and the right side 20 are obtusely coupled to the front 14 and acutely coupled to the back 16 defining respectively a left compartment 40 and a right compartment 42 of the cabinet 12. The left compartment 40 and the right compartment 42 are triangularly shaped when viewed longitudinally.

The pair of left walls 36 and a strip 37 of the front 14 between the left walls 36 extend past the top 22, defining a rectangle 44. The rectangle 44 has a lateral brace 46 coupled to and extending between the pair of left walls 36, defining a back section 48 and a front section 50. The left side 18 extends past the top 22 defining a surface storage area 52. The surface storage area 52 is triangular.

A plurality of cups 54 is coupled to and positioned through the top 22. The cups 54 are positioned in the surface storage area 52, such that the cups 54 are configured for storage of spoons, forks, knives, straws, disposable cups and other items. Preferably, the plurality of cups 54 comprises four cups 54.

Respective ones of a plurality of drawers 56 are positioned between and slidably coupled to the pair of left walls 36. Drawers 56 also are positioned between and slidably coupled to the pair of right walls 38. A plurality of bins 58 is positioned in the left compartment 40. Each of the bins 58 is hingedly coupled to the left side 18 proximate to the front 14. Preferably, the plurality of bins 58 comprises three bins 58. A cup tray 60 that is complimentary to and positioned in an uppermost bin 62 is configured for storage of variously sized cups. The cup tray 60 comprises a plurality of concavities 64 positioned in a panel 66 coupled to an interior 68 of the cup tray 60.

A plurality of cubby holes 70 is positioned in the left compartment 40 below the top 22 and above the plurality of bins 58. Each cubby hole 70 is defined by a respective one of a plurality of separators 72, the top 22 and an upper panel 73. Preferably, the plurality of separators 72 comprises one separator 72, such that the plurality of cubby holes 70 comprises two cubby holes 70.

A plurality of rollers 74 is coupled to the bottom 24. Preferably, the rollers 74 comprise castors 76, the plurality of rollers 74 comprises four rollers 74, and each roller 74 is coupled to the bottom 24 proximate to a respective corner 78 of the bottom 24. A cooler 80 is positioned in the top 22 and extends into the internal space 26. The cooler 80 is insulated and positioned in the back section 48. A lid 82, which is complimentary to an upper opening 84 of the cooler 80 and insulated, is hingedly coupled to the cooler 80 proximate to the back 16.

A power module 86 is coupled to the cabinet 12 and positioned in the interior space 26. The power module 86 comprises at least one battery 88. A light 90, which is extendable from the interior space 26 through a complimentary aperture 92 in the top 22, is operationally coupled to the power module 86. The light 90 is stowable in the interior space 26 when not needed and extendable when illumination is required. Preferably, the light 90 is tubular and positioned proximate to the back 16 and the right side 20.

Each of a plurality of electronic locks 94 is coupled to the cabinet 12 and operationally coupled to a respective one of the plurality of drawers 56. Each of the electronic locks 94 is configured to selectively render the respective one of the plurality of drawers 56 in either a locked or an unlocked state. A keypad 96, which is reversibly couplable to the top 22, is operationally couplable to the power module 86 and to each of the electronic locks 94. The keypad 96 is configured to selectively unlock one or more of the plurality of drawers 56. A manual lock 98 is operationally coupled to each of the plurality of drawers 56. The manual lock 98 must be disengaged prior to the user employing the keypad 96. The manual lock 98 is positioned in the arcuate cavity 28 proximate to the top 22.

A pill manipulator 100 that is capable of cutting and crushing pills is positioned on the top 22. Preferably, the pill manipulator 100 is positioned in the front section 50 of the rectangle 44. A trash receptacle 102 is positioned in the right compartment 42 proximate to the back 16 and below the light 90. The trash receptacle 102 has an opening 104 proximate to an upper edge 106, such that the opening 104 is accessible to a user standing in the arcuate cavity 28 for disposal of trash. Preferably, the opening 104 is circular. The trash receptacle 102 is quadrilaterally shaped when viewed longitudinally.

A sharps receptacle 108 is positioned in the right compartment 42 proximate to the front 14. The sharps receptacle 108 has an aperture 110 proximate to an upper rim 112, such that the aperture 110 is accessible to a user standing in the arcuate cavity 28 for disposal of sharps. Preferably, the aperture 110 is square. The sharps receptacle 108 is triangular when viewed longitudinally. The sharps receptacle 108 and the trash receptacle 102 together are triangular when viewed longitudinally and are complimentary to the right compartment 42.

A decorative drawer front 114 is positioned below the top 22 and above the drawers 56 positioned between the pair of left walls 36. Each of a plurality of handles 116 is coupled to a respective one of the plurality of drawers 56, the plurality of bins 58 and the decorative drawer front 114. Preferably, the plurality of handles 116 comprises eleven handles 116.

In use, the rollers 74 are positioned on the cabinet 12 imparting mobility. The cavity 28 is configured to allow the user ready access to the trash receptacle 102, the sharps receptacle 108, the bins 58, the cubby holes 70 and, upon unlocking with the keypad 96, the drawers 56. Various utensils and cups stored in the surface storage area 52 and cooled items stored in the cooler 80 are readily accessible. The pill manipulator 100 is configured to use in cutting and crushing pills.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An medications dispensing cart comprising:

a cabinet, said cabinet having a front, a back, a left side, a right side, a top and a bottom defining an internal space;

a pair of left walls and a pair of right walls positioned in said internal space;

a plurality of drawers, respective said drawers being positioned between and slidably coupled to said pair of left walls, respective said drawers being positioned between and slidably coupled to said pair of right walls;

a plurality of rollers, said rollers being coupled to said bottom;

a cooler, said cooler being positioned in said top and extending into said internal space;

a power module, said power module being coupled to said cabinet and positioned in said interior space;

a light, said light being extendable from said interior space through a complimentary aperture in said top, said light being operationally coupled to said power module, such that said light is stowable in said interior space when not needed and extendable when illumination is required;

a plurality of electronic locks, each said electronic lock being coupled to said cabinet and operationally coupled to a respective one of said plurality of drawers, such that each of said electronic locks is configured to selectively render said respective one of said plurality of drawers in either a locked or an unlocked state;

a keypad, said keypad being reversibly couplable to said top, said keypad being operationally couplable to said power module and each of said electronic locks;

a manual lock, said manual lock being operationally coupled to each of said plurality of drawers, such that said manual lock must be disengaged prior to the user employing said keypad;

a pill manipulator, said pill manipulator being capable of cutting and crushing pills, said pill manipulator being positioned on said top; and an arcuate cavity positioned in said front substantially equally distant from said left side and said right side, said cavity extending from said bottom to said top, such that said cavity is positioned to accommodate the user.

2. The cart of claim 1, further including a shelf, said shelf being slidably extendable from said interior space through a complimentary slot in said front, said slot being positioned in said arcuate cavity proximate to said top.

3. The cart of claim 1, further including said rollers comprising castors.

4. The cart of claim 1, further comprising:

said plurality of rollers comprising four rollers; and each said roller being coupled to said bottom proximate to a respective corner of said bottom.

5. The cart of claim 1, further including said power module comprising at least one battery.

6. The cart of claim 1, further comprising:

said light being tubular; and said light being positioned proximate to said back and said right side.

7. The cart of claim 1, further said manual lock being positioned in said arcuate cavity proximate to said top.

8. The cart of claim 1, further comprising:

a trash receptacle, said trash receptacle being positioned in said right compartment proximate to said back and below said light, said trash receptacle having an opening proximate to an upper edge, such that said opening is accessible to a user standing in said arcuate cavity for disposal of trash, said opening being circular, said trash receptacle being quadrilaterally shaped when viewed longitudinally;

a sharps receptacle, said sharps receptacle being positioned in said right compartment proximate to said front, said sharps receptacle having an aperture proximate to an upper rim, such that said aperture is accessible to a user standing in said arcuate cavity for disposal of sharps, said aperture being square, said sharps receptacle being triangular when viewed longitudinally; and said sharps receptacle and said trash receptacle together being triangular when viewed longitudinally and complimentary to said right compartment.

9. The cart of claim 1, further including a decorative drawer front, said decorative drawer front being positioned below said top and above said respective drawers positioned between said pair of left walls.

10. The cart of claim 9, further including a plurality of handles, each said handle being coupled to a respective one of said plurality of drawers, said plurality of bins and said decorative drawer front, said plurality of handles comprising eleven handles.

11. An medications dispensing cart comprising:

a cabinet, said cabinet having a front, a back, a left side, a right side, a top and a bottom defining an internal space;

a pair of left walls and a pair of right walls positioned in said internal space;

a plurality of drawers, respective said drawers being positioned between and slidably coupled to said pair of left walls, respective said drawers being positioned between and slidably coupled to said pair of right walls;

a plurality of rollers, said rollers being coupled to said bottom;

a cooler, said cooler being positioned in said top and extending into said internal space;

a power module, said power module being coupled to said cabinet and positioned in said interior space;

a light, said light being extendable from said interior space through a complimentary aperture in said top, said light being operationally coupled to said power module, such that said light is stowable in said interior space when not needed and extendable when illumination is required;

a plurality of electronic locks, each said electronic lock being coupled to said cabinet and operationally coupled to a respective one of said plurality of drawers, such that each of said electronic locks is configured to selectively render said respective one of said plurality of drawers in either a locked or an unlocked state;

a keypad, said keypad being reversibly couplable to said top, said keypad being operationally couplable to said power module and each of said electronic locks;

a manual lock, said manual lock being operationally coupled to each of said plurality of drawers, such that said manual lock must be disengaged prior to the user employing said keypad;

a pill manipulator, said pill manipulator being capable of cutting and crushing pills, said pill manipulator being positioned on said top;

each of said walls being coupled to said front, said back, said top and said bottom;

said pair of left walls being positioned proximate to said left side;

said pair of right walls being positioned proximate to said right side;

said back being dimensionally wider than said front, such that said left side and said right side are obtusely coupled to said front and acutely coupled to said back defining respectively a left compartment and a right compartment of said cabinet;

said left compartment and said right compartment being triangularly shaped when viewed longitudinally;

said back extending past said top, defining a retaining ridge;

said pair of left walls, said left side, and a strip of said front between said left walls extending past said top defining a rectangle;

said rectangle having a lateral brace coupled to and extending between said pair of left walls defining a back section and a front section;

said left side extending past said top defining a surface storage area; and said surface storage area being triangular.

12. The cart of claim 11, further including a plurality of cups being coupled to and positioned through said top, said cups being positioned in said surface storage area, such that said cups are configured for storage of spoons, forks, knives, straws, disposable cups and other items, said plurality of cups comprising four cups.

13. The cart of claim 11, further including a plurality of bins, said plurality of bins being positioned in said left compartment, each of said bins being hingedly coupled to said left side proximate to said front, said plurality of bins comprising three bins.

14. The cart of claim 13, further including a cup tray, said cup tray being complimentary to and positioned in an uppermost said bin, such that said tray is configured for storage of variously sized cups, said cup tray comprising a plurality of concavities positioned in a panel, said panel being coupled to an interior of said cup tray.

15. The cart of claim 11, further comprising:

a plurality of cubby holes, said cubby holes being positioned in said left compartment below said top and above said plurality of bins;

each said cubby hole being defined by a respective one of a plurality of separators, said top and an upper panel; and said plurality of separators comprising one separator, such that said plurality of cubby holes comprises two cubby holes.

16. The cart of claim 11, further comprising:

said cooler being insulated;

said cooler being positioned in said back section;

a lid, said lid being complimentary to an upper opening of said cooler, said lid being insulated; and said lid being hingedly coupled to said cooler proximate to said back.

17. The cart of claim 11, further including said pill manipulator being positioned in said front section of said rectangle.

18. An medications dispensing cart comprising:

a cabinet, said cabinet having a front, a back, a left side, a right side, a top and a bottom defining an internal space;

an arcuate cavity positioned in said front substantially equally distant from said left side and said right side, said cavity extending from said bottom to said top, such that said cavity is positioned to accommodate the user;

said back extending past said top, defining a retaining ridge;

a shelf, said shelf being slidably extendable from said interior space through a complimentary slot in said front, said slot being positioned in said arcuate cavity proximate to said top;

a pair of left walls and a pair of right walls positioned in said internal space, each of said walls being coupled to said front, said back, said top and said bottom, said pair of left walls being positioned proximate to said left side, said pair of right walls being positioned proximate to said right side;

said back being dimensionally wider than said front, such that said left side and said right side are obtusely coupled to said front and acutely coupled to said back defining respectively a left compartment and a right compartment of said cabinet, said left compartment and said right compartment being triangularly shaped when viewed longitudinally;

said pair of left walls, said left side, and a strip of said front between said left walls extending past said top defining a rectangle, said rectangle having a lateral brace coupled to and extending between said pair of left walls defining a back section and a front section;

said left side extending past said top defining a surface storage area, said surface storage area being triangular;

a plurality of cups being coupled to and positioned through said top, said cups being positioned in said surface storage area, such that said cups are configured for storage of spoons, forks, knives, straws, disposable cups and other items, said plurality of cups comprising four cups;

a plurality of drawers, respective said drawers being positioned between and slidably coupled to said pair of left walls, respective said drawers being positioned between and slidably coupled to said pair of right walls;

a plurality of bins, said plurality of bins being positioned in said left compartment, each of said bins being hingedly coupled to said left side proximate to said front, said plurality of bins comprising three bins;

a cup tray, said cup tray being complimentary to and positioned in an uppermost said bin, such that said tray is configured for storage of variously sized cups, said cup tray comprising a plurality of concavities positioned in a panel, said panel being coupled to an interior of said cup tray;

a plurality of cubby holes, said cubby holes being positioned in said left compartment below said top and above said plurality of bins, each said cubby hole being defined by a respective one of a plurality of separators, said top and an upper panel, said plurality of separators comprising one separator, such that said plurality of cubby holes comprises two cubby holes;

a plurality of rollers, said rollers being coupled to said bottom, said rollers comprising castors, said plurality of rollers comprising four rollers, each said roller being coupled to said bottom proximate to a respective corner of said bottom;

a cooler, said cooler being positioned in said top and extending into said internal space, said cooler being insulated, said cooler being positioned in said back section;

a lid, said lid being complimentary to an upper opening of said cooler, said lid being insulated, said lid being hingedly coupled to said cooler proximate to said back;

a power module, said power module being coupled to said cabinet and positioned in said interior space, said power module comprising at least one battery;

a light, said light being extendable from said interior space through a complimentary aperture in said top, said light being operationally coupled to said power module, such that said light is stowable in said interior space when not needed and extendable when illumination is required, said light being tubular, said light being positioned proximate to said back and said right side;

a plurality of electronic locks, each said electronic lock being coupled to said cabinet and operationally coupled to a respective one of said plurality of drawers, such that each of said electronic locks is configured to selectively render said respective one of said plurality of drawers in either a locked or an unlocked state;

a keypad, said keypad being reversibly couplable to said top, said keypad being operationally couplable to said power module and each of said electronic locks, such that said keypad is configured to selectively unlock one or more of said plurality of drawers;

a manual lock, said manual lock being operationally coupled to each of said plurality of drawers, such that said manual lock must be disengaged prior to the user employing said keypad, said manual lock being positioned in said arcuate cavity proximate to said top;

a pill manipulator, said pill manipulator being capable of cutting and crushing pills, said pill manipulator being positioned on said top, said pill manipulator being positioned in said front section of said rectangle;

a trash receptacle, said trash receptacle being positioned in said right compartment proximate to said back and below said light, said trash receptacle having an opening proximate to an upper edge, such that said opening is accessible to a user standing in said arcuate cavity for disposal of trash, said opening being circular, said trash receptacle being quadrilaterally shaped when viewed longitudinally;

a sharps receptacle, said sharps receptacle being positioned in said right compartment proximate to said front, said sharps receptacle having an aperture proximate to an upper rim, such that said aperture is accessible to a user standing in said arcuate cavity for disposal of sharps, said aperture being square, said sharps receptacle being triangular when viewed longitudinally;

said sharps receptacle and said trash receptacle together being triangular when viewed longitudinally and complimentary to said right compartment;

a decorative drawer front, said decorative drawer front being positioned below said top and above said respective drawers positioned between said pair of left walls;

a plurality of handles, each said handle being coupled to a respective one of said plurality of drawers, said plurality of bins and said decorative drawer front, said plurality of handles comprising eleven handles; and wherein said rollers are positioned on said cabinet imparting mobility, and such that said cavity is configured to allow the user ready access to said trash receptacle, said sharps receptacle, said bins, said cubby holes and, upon unlocking with said keypad, said drawers, and wherein various utensils and cups stored in said surface storage area and cooled items stored in said cooler are readily accessible, and such that said pill manipulator is configured for use is cutting and crushing pills.

* * * * *